US008245891B2

(12) United States Patent
Eriksen

(10) Patent No.: US 8,245,891 B2
(45) Date of Patent: Aug. 21, 2012

(54) POUR SPOUT WITH DRIP SUPRESSING FEATURE

(75) Inventor: Goran Eriksen, Prachuapkirikhan (TH)

(73) Assignee: Barproducts.com, Inc., Largo, FL (US)

( * ) Notice: Subject to any disclaimer, the term of this patent is extended or adjusted under 35 U.S.C. 154(b) by 396 days.

(21) Appl. No.: 12/719,575

(22) Filed: Mar. 8, 2010

(65) Prior Publication Data

US 2010/0230447 A1 Sep. 16, 2010

Related U.S. Application Data

(60) Provisional application No. 61/210,026, filed on Mar. 13, 2009.

(51) Int. Cl.

| | |
|---|---|
| ***B67D 3/00*** | (2006.01) |
| ***B65D 5/72*** | (2006.01) |
| ***B65D 25/40*** | (2006.01) |
| ***B65D 35/38*** | (2006.01) |

(52) U.S. Cl. ..... 222/481.5; 222/571; 222/478; 222/567

(58) Field of Classification Search ..... 222/481.5, 222/571, 478, 567, 108

See application file for complete search history.

(56) References Cited

U.S. PATENT DOCUMENTS

| | | | | |
|---|---|---|---|---|
| 2,750,063 | A * | 6/1956 | Opsitnik | 222/571 |
| 3,630,419 | A * | 12/1971 | Pierce | 222/478 |
| 3,868,051 | A * | 2/1975 | Goof | 222/571 |
| 3,966,099 | A | 6/1976 | Sanford, Jr. et al. | |
| 4,427,138 | A | 1/1984 | Heinlein | |
| 4,949,884 | A * | 8/1990 | Dahl | 222/570 |
| 5,072,861 | A * | 12/1991 | Jou | 222/481 |
| 5,397,027 | A * | 3/1995 | Koch et al. | 222/1 |
| 5,799,836 | A * | 9/1998 | Lee | 222/189.07 |
| 6,012,617 | A * | 1/2000 | Knight et al. | 222/481.5 |
| 6,026,994 | A * | 2/2000 | Rigel | 222/538 |
| 6,230,944 | B1 | 5/2001 | Castellano et al. | |
| 6,662,976 | B2 * | 12/2003 | Jensen et al. | 222/481.5 |
| 6,742,678 | B1 | 6/2004 | Krystopik, Jr. | |
| 2005/0006418 | A1 * | 1/2005 | Rigel | 222/481.5 |
| 2008/0073383 | A1 * | 3/2008 | McDonald | 222/500 |

* cited by examiner

*Primary Examiner* — Kevin P Shaver
*Assistant Examiner* — Vishal Pancholi
(74) *Attorney, Agent, or Firm* — Lonnie R. Drayer

(57) ABSTRACT

A one piece elastomeric pour spout is adapted to couple within the neck of a bottle, and has a substantially flat pouring end, whereby when the pour spout is coupled within the neck of a bottle, the pouring end is substantially flush with an annular lip of the neck of the bottle. The bottle may be recapped with original cap without removing the pour spout. The pour spout is further provided with a feature that suppresses dripping from the pour spout at the end of a pour.

14 Claims, 2 Drawing Sheets

POUR SPOUT WITH DRIP SUPRESSING FEATURE

FIELD OF THE INVENTION

The present invention relates generally to a pour spout for insertion in and coupling with the neck of a bottle to facilitate the smooth and even pouring of liquid from the bottle and suppressing dripping from the pour spout.

BACKGROUND OF THE INVENTION

Pour spouts are commonly comprised of a cylindrical body member and a protruding member or spout. Pour spouts may be flanged or not, and are made from a variety of materials, both pliable and rigid. Pour spouts are usually adapted to couple with the necks of a variety of bottles such that a cylindrical body member is inserted into and coupled with the neck of the bottle in a manner that allows the protruding member or spout to protrude or extend from the cylindrical body member beyond the annular lip of the liquid-containing bottle. The cylindrical body member may be annular or single or plural-channeled to allow liquid to flow from the bottle through the cylindrical body member and into an external receiving vessel, such as a drinking glass.

Pour spouts facilitate smooth and even pouring of liquids, reduce or eliminate splashing, and provide the ability to control the velocity of the flow of liquid as it is being discharged through the pour spout.

One drawback of using pour spouts is that, unless the pour spout is able to be sealed or capped, the liquid in the bottle is left exposed to the environment, which commonly results in a number of problems, including oxidation, evaporation, insect infestation, and/or other contamination. Although pour spouts may be inserted and removed and the bottle recapped with its original cap after each use, this process in cumbersome and often impractical.

Further, even though many pour spouts provide sealing mechanisms, these mechanisms vary widely in their abilities to prevent oxidation, evaporation, insect infestation, and/or other contamination, and rarely provide the same measure of sealing ability as the original cap that came with the bottle or vessel.

Therefore, there has been a longstanding need for a pour spout that allows for the recapping of bottles with their original bottle caps, without necessitating the removal of the pour spout. The present invention provides a pour spout that facilitates the smooth and even pouring of liquids, reduces or eliminates splashing, and provides the ability to control the velocity of the flow of liquid as it is being discharged while suppressing dripping from the pour spout at the end of a pour, and is also is adapted to couple within the neck of a bottle without protruding from the annular lip of the bottle, enabling the bottle to be recapped with its original bottle cap without having to remove the pour spout.

DISCUSSION OF THE PRIOR ART

U.S. Pat. No. 4,427,138 teaches a plastic pourer for insertion into the mouth of bottle when the bottle cap is assembled with the container during the bottling process. The bottle cap can be removed from and replaced on the bottle using threads on the exterior of the neck of the bottle and interior of the cap, leaving the plastic pourer in place in the neck of the bottle. The plastic pourer has independent struts that extend from the lower side of a closure disc of the pourer into the neck of the bottle to secure the pourer in place.

U.S. Pat. No. 6,230,944 teaches a pour spout including an insertable member designed to engage an internal surface of the neck of a bottle, and an external spout extending above the bottle. A sealable cap is operably attached to the external spout. The cap may be operated between open and closed positions by causing a conical stopper member of the cap to move varying distances into the spout.

U.S. Pat. No. 6,742,678 teaches a pour spout including a cap securable to the pour spout using threads on an external surface of the pour spout protruding from the neck of a bottle and threads on an internal surface of the cap.

SUMMARY OF THE INVENTION

The present invention related to an aftermarket pour spout that facilitates the smooth and even pouring of liquids while suppressing dripping from the pour spout at the end of a pour, that is adapted to a couple within the neck of a bottle without protruding from an annular lip of a neck of the bottle whereby the bottle may be recapped with its original cap without removing the pour spout.

BRIEF DESCRIPTION OF THE DRAWINGS

The invention will now be described, by way of example only, with reference to the accompanying figures in which.

DETAILED DESCRIPTION OF THE INVENTION

Figure 1:
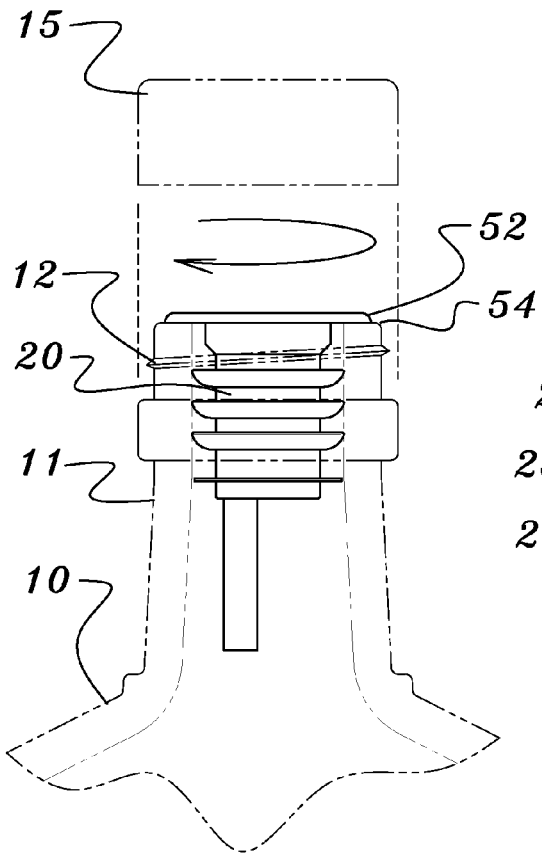
FIG. 1 is a fragmentary side view, of the new pour spout coupled within the neck of a bottle.
Figure 2:
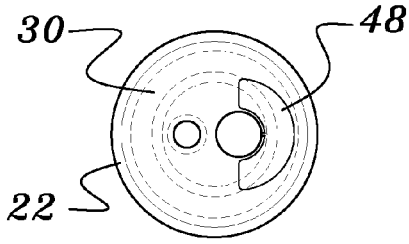
FIG. 2 is a top view looking down on a substantially flat pouring end of the pour spout shown in FIG. 1.

FIG. 1 shows a bottle 10 having a neck 11 with threads 12 on an exterior surface of the neck. The bottle has a cap 15 with threads on an interior surface (not shown) for mating with the threads on the neck of the bottle and securing the cap to the bottle. The bottle is filled with a liquid, such as liquor, and the cap is threadably attached to the liquid containing bottle as part of a bottling process. Thereafter the filled bottle is shipped from the bottling facility and in due course is supplied to the end user. The end user may be a purveyor of alcoholic beverages such as a tavern or bar that sells alcoholic beverages to patrons. A mixologist trained in the preparation of beverages containing one or more liquors and possibly other non-alcoholic liquids such as juices and carbonated beverages, removes the cap from the bottle for dispensing a designated amount of liquor into a container such as a drinking glass or shot glass. It is known for the mixologist to attach a prior art pour spout to the neck of the bottle 10 to better facilitate the dispensing of liquor from the bottle.

It is desirable that after the liquor has been dispensed the bottle be resealed to prevent the introduction of foreign matter into the bottle. While there are prior art pour spouts that include bottle sealing mechanisms, these pour spouts require special caps and may be costly, or the special caps may be misplaced. A pour spout 20 according to the present invention may be coupled to the interior of the neck of a bottle and allow the cap that was originally furnished with the bottle during the bottling process to be used to reseal the bottle.

Figure 3:
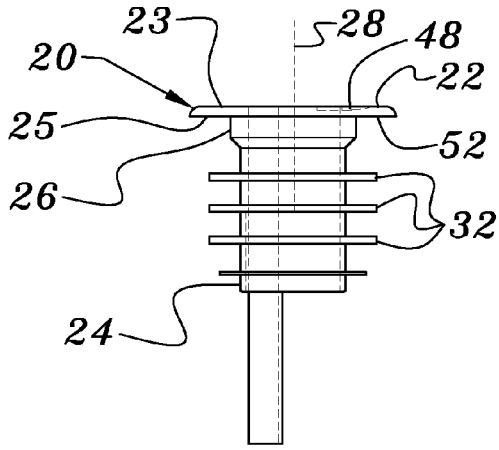
FIG. 3 is a side view of the pour spout shown in FIG. 1.
Figure 4:
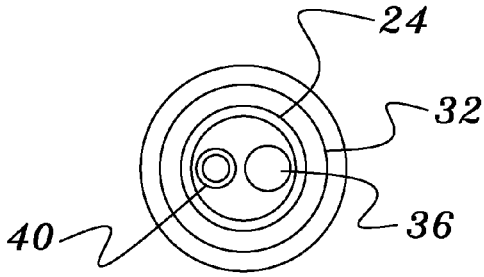
FIG. 4 is bottom view looking of the pour spout shown in FIG. 1.
Figure 5:
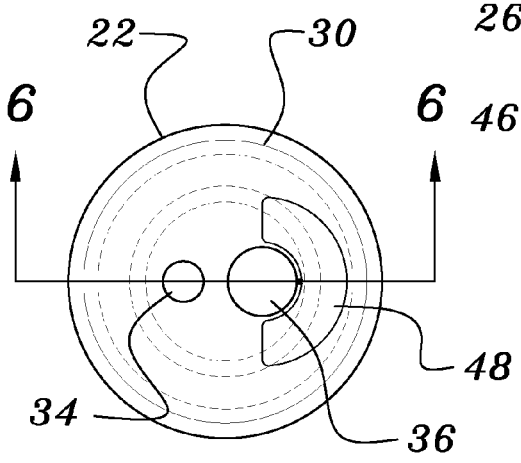
FIG. 5 is an enlarged top view looking down on the substantially flat pouring end of the of the pour spout shown in FIG. 1.
Figure 6:
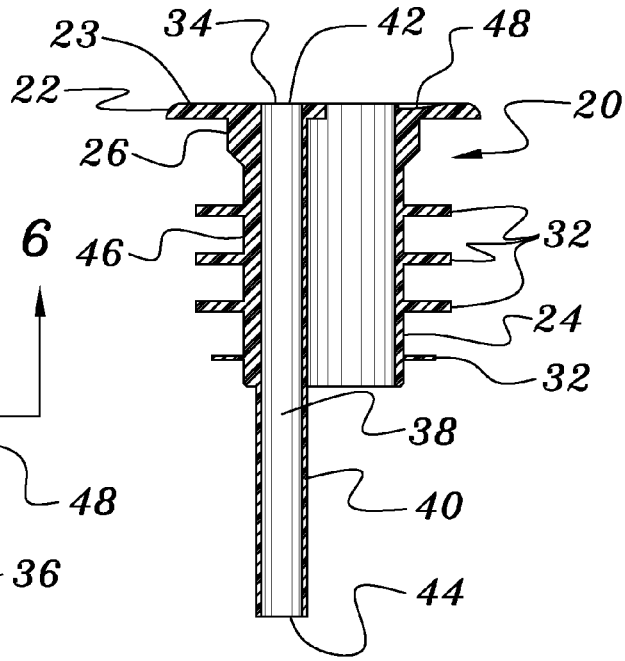
FIG. 6 is a cross-sectional side view of the of the pour spout shown in FIG. 1, taken at line 6-6 of FIG. 5.
Figure 7:
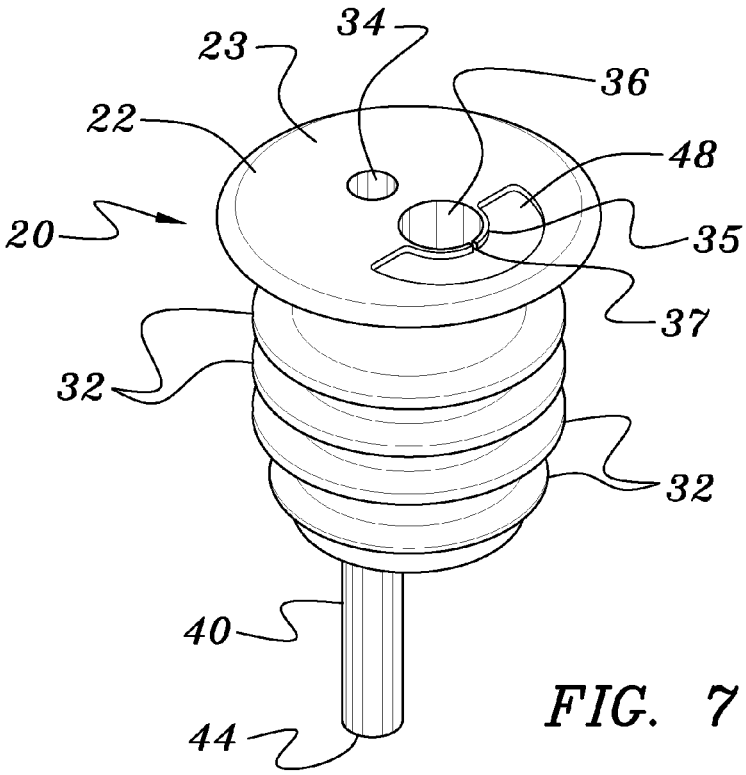
FIG. 7 is a perspective view of the pour spout shown in FIG. 1.

FIGS. 2-7 show the structure of a one piece pour spout 20 according to the present invention. The new pour spout comprises a one piece elastomeric member having a disc portion 22. The pour spout may be molded of any suitable elastomeric material having adequate elastic properties to facilitate the placement by hand of the pour spout into a neck of a bottle to form a seal between the bottle and the pour spout, as well as chemical properties such that the pour spout will not deteriorate or cause contamination when contacted by the liquid contents of the bottle. The disc portion has a top surface 23 and a bottom surface 25. The bottom surface of the disc portion 22 is joined to a coaxial hollow cylindrical portion 24 by a coaxial hollow intermediary portion 26. The common longitudinal axis is indicated in FIG. 3 by reference character 28.

The hollow intermediary portion 26 has an outside diameter that is smaller than an outside diameter of the disc portion 22 and larger than an outside diameter of the hollow cylindrical portion 24. It is an important feature of the new pour spout 20 that no portion of the one piece pour spout extends beyond the top surface 25 of the disc portion like the dispensing tubes of commonly used prior art pour spouts. It is the protruding dispensing tubes of prior art pour spouts that prevent the resealing of a bottle with the originally furnished cap without first removing a prior art pour spout from the bottle.

The hollow cylindrical portion 24 has longitudinally spaced radially outward projecting circular sealing fins 32 extending from an exterior surface of the hollow cylindrical portion for engaging an inner surface of a neck of a bottle 10. The pour spout 20 illustrated in the drawings has four sealing fins, but the number, spacing and sizes of the sealing fins can be varied to accommodate bottles of varying dimensions. It is important that the dimensions and elastic properties of the sealing fins facilitate the relatively easy insertion of the hollow cylindrical portion 24 into the neck of a bottle by hand without the aid of additional insertion tools. While the pour spout of the present invention may be sold and used as an aftermarket device, it is understood during the bottling process it could be assembled with a bottle before the placement of a threaded cap on the bottle. As used herein and in the claims the term aftermarket is understood to have its common meaning of the marketing of additional equipment, or replacement or repair parts for a manufactured product following the purchase of the manufactured product.

The disc portion 22 has first and second circular apertures 34, 36 therethrough. Each of the circular apertures has a center that is collinear with the center of the other aperture and with a center of the disc portion. The centers of the two circular apertures are spaced apart from the center of the disc portion. As used herein and in the claims the term center is understood to have its common meaning of a point equally distant from all points on the circumference of a circle. As used herein and in the claims the term collinear is understood to have its common meaning of lying on the same straight line.

The first circular aperture 34 is smaller than the second circular aperture 36 and is aligned with a bore 38 of a vent tube 40. The vent tube has a first end 42 adjacent an interior surface of the disc portion 22 and extends through the interiors of the hollow cylindrical portion 24 and the hollow intermediary portion 26, preferably to a second end 44 located outside the hollow cylindrical portion. An exterior surface of the vent tube 40 is optionally joined to an interior surface of the hollow cylindrical portion 24 by a rib 46. When the liquid contents of a bottle fitted with the pour spout 20 are to be dispensed through the second aperture 36 the bottle is tipped from a vertical orientation toward a more horizontal orientation. As the liquid is dispensed from the bottle through the second circular aperture, the vent tube 40 allows air to enter the bottle, equalizing the pressure within the bottle and preventing the contents of the bottle from backing up and pouring out in an uneven manner.

The top surface 23 of the disc portion 22 has an arcuate depression 48 therein that extends only partially around and concentric with the second circular aperture 36 in the disc portion. In a prototype the depth of the arcuate depression is in the range of one to two millimeters deep. The arcuate depression is nearer the second circular aperture than the periphery of the flat disc portion. The second circular aperture 36 is a spout, that is to say an opening that allows the passage of liquids therethrough directly from the interiors of the hollow cylindrical portion 24 and hollow intermediary portion 26 to the environment. The arcuate depression 48 locally reduces the thickness of the disc portion 22 causing that portion of the disc portion encompassed by the arcuate depression to be slightly more flexible than the remainder of the disc portion when a liquid is being dispensed though the second circular aperture 36 and this facilitates more controllable flowing of the liquid from the bottle. A side wall 35 of the arcuate depression provides a portion of the rim of the second circular aperture. A notch 37 in the side wall 35 of the arcuate depression is located adjacent the second circular aperture 36. Preferably the notch 37 is aligned with the center of the first aperture and with the center of the disc portion. Preferably the notch extends from a top edge of the sidewall to the bottom end of the sidewall, which in a prototype is a distance of one to two millimeters. It has been observed that the notch 37 in the side wall 35 of the arcuate depression suppresses dripping from the second circular aperture when at the end of a pour the bottle is being tipped from a pouring position towards a position where the neck of the bottle extends upwards.

In use the circular sealing fins 32 of the hollow cylindrical portion 24 and hollow intermediary portion 26 of the pour spout 20 are coupled with the neck of a bottle 10 with a flange surface 52 of the disc portion 22 adjacent the outer circumferential surface of the intermediary portion 26 being a flange sized to engage, but not extend radially beyond a rim 54 at a mouth of the neck of the bottle. The neck of the bottle is furnished with exterior threads for mating with a cap having interior threads and the cap is threaded onto the neck of the bottle to seal the bottle with an interior surface of the top of the cap being adjacent the top surface 25 of the disc portion of the pour spout.

Put another way the present invention provides an aftermarket pour spout 20 for coupling with the neck of a bottle 10 having threads on an exterior surface of the neck and a cap provided with threads on an exterior surface thereof for engaging the threads on the neck of the bottle. The bottle contains a liquid and is sealed by the cap for distribution and sale. The new pour spout is coupled with the neck of the bottle only after the cap has been removed from the bottle. The cap is replaceable onto the neck of the bottle to seal the bottle with an interior surface of a top of the cap adjacent the top surface 25 of the disc portion 22 of the pour spout.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

The invention claimed is:

1. A pour spout comprising:

a disc portion having a top surface and a bottom surface, the bottom surface of the disc portion being joined to a coaxial hollow cylindrical portion;

the disc portion having first and second circular apertures therethrough;

the first circular aperture being aligned with a bore of a vent tube; and the top surface of the disc portion having an arcuate depression therein that extends only partially around and is concentric with the second circular aperture in the disc portion, the second circular aperture being an opening that allows the passage of liquids therethrough directly from an interior of the hollow cylindrical portion, the arcuate depression having a side wall that provides a portion of a rim of the second circular aperture, the side wall of the arcuate depression having a notch therein that is located adjacent the second circular aperture.

2. The pour spout of claim 1 wherein the notch is aligned with a center of the first aperture and with a center of the disc portion.

3. The pour spout of claim 1 wherein the notch extends from a top edge of the sidewall to a bottom end of the sidewall.

4. The pour spout of claim 2 wherein the notch extends from a top edge of the sidewall to a bottom end of the sidewall.

5. A pour spout comprising:

a one piece elastomeric member having a disc portion, the disc portion having a top surface and a bottom surface, the bottom surface of the disc portion being joined to a coaxial hollow cylindrical portion by a coaxial hollow intermediary portion, the hollow intermediary portion having an outside diameter that is smaller than an outside diameter of the disc portion and larger than an outside diameter of the hollow cylindrical portion, wherein no portion of the one piece elastomeric member extends beyond an exterior flat surface of the disc portion;

the hollow cylindrical portion having longitudinally spaced radially outward projecting circular sealing fins extending from an exterior surface of the hollow cylindrical portion for engaging an inner surface of a neck of a bottle;

the disc portion having first and second circular apertures therethrough, each of the circular apertures having a center that is collinear with the center of the other aperture and with a center of the disc portion, the centers of the two circular apertures being spaced apart from the center of the disc portion;

the first circular aperture being aligned with a bore of a vent tube that has a first end adjacent an interior surface of the disc portion and extends through the interiors of the hollow cylindrical portion and the hollow intermediary portion to a second end; and the top surface of the disc portion having an arcuate depression therein that extends only partially around and is concentric with the second circular aperture in the disc portion, the second circular aperture being an opening that allows the passage of liquids therethrough directly from the interiors of the hollow cylindrical portion and hollow intermediary portion to the environment.

6. The pour spout of claim 5 wherein the arcuate depression having a side wall that provides a portion of a rim of the second circular aperture, the side wall of the arcuate depression having a notch therein that is located adjacent the second circular aperture.

7. The pour spout of claim 5 wherein an outer circumferential surface of the intermediary portion is sized to engage the interior surface of the neck of a bottle.

8. The pour spout of claim 7 wherein a flange surface of the disc portion adjacent the outer circumferential surface of the intermediary portion is a flange for engaging, but not extend radially beyond a rim at a mouth of a neck of a bottle.

9. The pour spout of claim 5 wherein an exterior surface of the vent tube is joined to an interior surface of the hollow cylindrical portion by a rib.

10. The pour spout of claim 5 wherein the arcuate depression is nearer the second circular aperture than the periphery of the flat disc portion.

11. The pour spout of claim 5 wherein the second end of the vent tube is located outside the hollow cylindrical portion.

12. The pour spout of claim 5 wherein the hollow cylindrical portion and hollow intermediary portion are coupled with the neck of a bottle with a flange surface of the disc portion adjacent the outer circumferential surface of the intermediary portion being a flange sized to engage, but not extend radially beyond a rim at a mouth of the neck of the bottle, the neck of the bottle being furnished with exterior threads for mating with a cap having interior threads and the cap being threaded onto the neck of the bottle to seal the bottle, an interior surface of the top of the cap being adjacent the exterior flat surface of the disc portion of the pour spout.

13. An aftermarket pour spout for coupling with the neck of a bottle having threads on an exterior surface of the neck and a cap provided with threads on an exterior surface thereof for engaging the threads on the neck of the bottle, the bottle containing a liquid and being sealed by the cap for distribution and sale, the pour spout being coupled with the neck of the bottle only after the cap has been removed from the bottle, the pour spout comprising:

a one piece elastomeric member having a disc portion, the disc portion having a top surface and a bottom surface, the bottom surface of the disc portion being joined to a coaxial hollow cylindrical portion by a coaxial hollow intermediary portion, the hollow intermediary portion having an outside diameter that is smaller than an outside diameter of the disc portion and larger than an outside diameter of the hollow cylindrical portion, wherein no portion of the one piece elastomeric member extends beyond an exterior flat surface of the disc portion;

the hollow cylindrical portion having longitudinally spaced radially outward projecting circular sealing fins extending from an exterior surface of the hollow cylindrical portion for engaging an inner surface of a neck of a bottle;

the disc portion having first and second circular apertures therethrough, each of the circular apertures having a center that is collinear with the center of the other aperture and with a center of the disc portion, the centers of the two circular apertures being spaced apart from the center of the disc portion;

the first circular apertures being aligned with a bore of a vent tube that has a first end adjacent an interior surface of the disc portion and extends through the interiors of the hollow cylindrical portion and the hollow intermediary portion to a second end located outside the hollow cylindrical portion;

the top surface of the disc portion having an arcuate depression therein that extends only partially around and concentric with the second circular aperture in the disc portion, the second circular aperture being an opening that allows the passage of liquids therethrough directly from the interiors of the hollow cylindrical portion and hollow intermediary portion to the environment; and the cap being replaceable onto the neck of the bottle to seal the bottle with an interior surface of a top of the cap being adjacent the exterior flat surface of the disc portion of the pour spout.

14. The pour spout of claim 13 wherein the arcuate depression has a side wall that provides a portion of a rim of the second circular aperture, the side wall of the arcuate depression having a notch therein that is located adjacent the second circular aperture.

* * * * *